US005801130A

United States Patent [19]

Francisco et al.

[11] Patent Number: 5,801,130

[45] Date of Patent: Sep. 1, 1998

[54] HIGH LOAD-CARRYING TURBO OILS CONTAINING AMINE PHOSPHATE AND DIMERCAPTOTHIADIAZOLE DERIVATIVES

[75] Inventors: Manual A. Francisco, Washington; Paul Joseph Berlowitz, East Windsor; Jeenok T. Kim, Holmdel, all of N.J.

[73] Assignee: Exxon Research and Engineering Company, Florham Park, N.J.

[21] Appl. No.: 813,740

[22] Filed: Mar. 7, 1997

Related U.S. Application Data

[63] Continuation of Ser. No. 577,782, Dec. 22, 1995, abandoned.

[51] Int. Cl.[6] ..... C10M 135/36

[52] U.S. Cl. ..... 508/272; 508/273; 508/274; 508/436

[58] Field of Search ..... 508/272, 273, 508/274, 425, 436

[56] References Cited

U.S. PATENT DOCUMENTS

| | | | |
|---|---|---|---|
| 2,836,564 | 5/1958 | Roberts et al. . | |
| 3,533,943 | 10/1970 | Papay . | |
| 3,775,321 | 11/1973 | Turnquest et al. . | |
| 3,859,218 | 1/1975 | Jervis et al. . | |
| 3,909,420 | 9/1975 | Turnquest et al. . | |
| 4,130,494 | 12/1978 | Shaub | 508/436 |
| 4,140,643 | 2/1979 | Davis . | |
| 4,193,882 | 3/1980 | Gemmill, Jr. . | |
| 4,575,431 | 3/1986 | Salentine | 508/436 |
| 4,849,118 | 7/1989 | Stauffer et al. | 508/273 |
| 5,055,584 | 10/1991 | Karol | 548/142 |
| 5,126,396 | 6/1992 | Orton et al. | 525/28 |
| 5,177,212 | 1/1993 | Karol et al. | 548/142 |
| 5,205,945 | 4/1993 | Cardis et al. . | |
| 5,279,751 | 1/1994 | Wu et al. . | |
| 5,342,531 | 8/1994 | Walters et al. | 508/272 |
| 5,354,484 | 10/1994 | Schwind et al. . | |
| 5,516,440 | 5/1996 | Dasai et al. . | |
| 5,536,423 | 7/1996 | Miyagawa et al. | 508/436 |
| 5,585,029 | 12/1996 | Kim et al. | 508/274 |

FOREIGN PATENT DOCUMENTS

| | | | |
|---|---|---|---|
| 0122317A1 | 10/1984 | European Pat. Off. | C10M 1/38 |
| 122317 | 10/1984 | European Pat. Off. . | |
| 0310366A1 | 4/1989 | European Pat. Off. | C10M 163/00 |
| 0382242A1 | 8/1990 | European Pat. Off. | C10M 141/10 |
| 382242 | 8/1990 | European Pat. Off. . | |
| 0434464A1 | 1/1991 | European Pat. Off. | C10M 141/08 |
| 0460317A1 | 12/1991 | European Pat. Off. | C10M 141/10 |

*Primary Examiner*—Sharon Gibson
*Assistant Examiner*—Cephia D. Toomer
*Attorney, Agent, or Firm*—Joseph J. Allocca

[57] ABSTRACT

This invention relates to synthetic based turbo oils, preferably polyol ester-based turbo oils which exhibit exceptional load-carrying capacity by use of a synergistic combination of sulfur (S)-based and phosphorous (P)-based load additives. The S-containing additives of the present invention are DMTD and its derivative including the capped DMTD and the DMTD dimer, and the P-containing component is one or more amine phosphates. The turbo oil composition consisting of the dual P/S additives of the present invention achieves an excellent load-carrying capacity, which is better than that obtained when each additive was used alone at a treat rate higher than or comparable to the total combination additive treat rate, and the lower concentration requirement of the P-based additive allows the turbo oil composition to meet US Navy MIL-L-23699 requirement on the Si seal compatibility.

8 Claims, No Drawings

HIGH LOAD-CARRYING TURBO OILS CONTAINING AMINE PHOSPHATE AND DIMERCAPTOTHIADIAZOLE DERIVATIVES

This is a continuation, of application Ser. No. 577,782, filed Dec. 22, 1995, now abandoned.

BACKGROUND OF THE INVENTION

1. Field of the Invention

This invention relates to synthetic oil-based, preferably polyol ester-based turbo oils which use a synergistic combination of phosphorous (P)-based and sulfur (S)-based load additive chemistries which allows the turbo oil formulation to impart exceptionally high load-carrying capacity and also to meet MIL-L-23699 Si seal compatibility requirement.

2. Description of the Prior Art

U.S. Pat. No. 4,140,643 discloses nitrogen- and sulfur-containing compositions that are prepared by reacting a DMTD with oil-soluble dispersant and subsequently reacting the intermediate thus formed with carboxylic acid or anhydride containing upto 10 carbon atoms having at least one olefinic bond. The resulting compositions are claimed to be useful in lubricants as dispersant, load-carrying additive, corrosion inhibitor, and inhibitors of Cu corrosivity and lead paint deposition.

U.S. Pat. No. 5,055,584 discloses maleic derivative of DMTD to be used as antiwear and antioxidant in lubricating composition.

U.S. Pat. No. 4,193,882 is directed to improved corrosion inhibiting lube composition that contains the reaction product of DMTD with oleic acid.

Other references which teach the use of DMTD derivatives in lube composition to improve one or several of performance features (antiwear, extreme pressure, corrosion inhibition, antioxidancy) are EP 310 366-B 1, U.S. Pat. No. 2,836,564, U.S. Pat. No. 5,126,396, U.S. Pat. No. 5,205,945, U.S. Pat. No. 5,177,212 and U.S. Pat. No. 5,278,751.

EP 434,464 is directed to lube composition or additive concentrate comprising metal-free antiwear and load-carrying additives containing sulfur and/or phosphorous and an amino-succinate ester corrosion inhibitor. The antiwear and load additives include mono- or di-hydrocarbyl phosphate or phosphite with the alkyl radical containing up to $C_{12}$, or an amine salt of such a compound, or a mixture of these; or mono- or dihydrocarbyl thiophosphate where the hydrocarbon (HC) radical is aryl, alkylaryl, arylalkyl or alkyl, or an amine salt thereof; or trihydrocarbyl dithiophosphate in which each HC radical is aromatic, alkylaromatic, or aliphatic; or amine salt of phosphorothioic acid; optionally with a dialkyl polysulfide and/or a sulfurized fatty acid ester.

U.S. Pat. No. 4,130,494 discloses a synthetic ester lubricant composition containing ammonium phosphate ester and ammonium organo-sulfonate, especially useful as aircraft turbine lubricants. The aforementioned lubricant composition have good extreme pressure properties and good compatibility with silicone elastomers.

U.S. Pat. No. 3,859,218 is directed to high pressure lube composition comprising a major portion of synthetic ester and a minor portion of load-bearing additive. The load-carrying additive package contains a mixture of a quaternary ammonium salt of mono-($C_1$–$C_4$) alkyl dihydrogen phosphate and a quarternary ammonium salt of di-($C_1$–$C_4$) alkyl monohydrogen phosphate. In addition to the improved high pressure and wear resistance, the lubricant provides better corrosion resistance and cause less swelling of silicone rubbers than known oils containing amine salts of phosphoric and thiophosphoric acids.

DETAILED DESCRIPTION

A turbo oil having unexpectedly superior load-carrying capacity comprises a major portion of a synthetic base oil selected from diesters and polyol ester base oil, preferably polyol ester base oil, and minor portion of a load additive package comprising a mixture of amine phosphate and 2,5-dimercapto-1,3,4-thiadizole (DMTD) or one of its derivatives and mixtures thereof.

The diester, which can be used in the high load-carrying lube composition of the present invention is formed by esterification of linear or branched $C_6$ to $C_{15}$ aliphatic alcohols with one of such dibasic acids as sebacic, adipic, azelaic acids. Examples of diester are di-2-ethyhexyl sebacate, di-octyl adipate.

The preferred synthetic base stock which is synthetic polyol ester base oil is formed by the esterification of aliphatic polyols with carboxylic acids. The aliphatic polyols contain from 4 to 15 carbon atoms and have from 2 to 8 esterifiable hydroxyl groups. Examples of polyols are trimethylolpropane, pentaerythritol, dipentaerythritol, neopentyl glycol, tripentaerythritol and mixtures thereof.

The carboxylic acid reactants used to produce the synthetic polyol ester base oil are selected from aliphatic monocarboxylic acid or a mixture of aliphatic monocarboxylic acids and aliphatic dicarboxylic acids. The carboxylic acids contain from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical penta-erytitol is a mixture which includes about 85 to 92% monopentaerythritol and 8 to 15% dipentaerythritol. A typical commercial technical pentaerythritol contains about 88% monopentaerythritol having the structural formula:

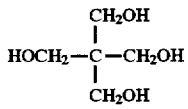

and about 12% of dipentaerythritol having the structural formula:

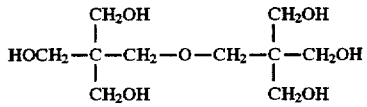

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the synthetic oil base stock is added a minor portion of an additive comprising a mixture of one or more amine phosphate(s) and DMTD or its derivatives or mixtures thereof. The DMTD derivatives referred to here include "capped" DMTD, where both mercaptans are reacted with various functional groups, and the dimer of the capped DMTD.

The amine phosphate used includes commercially available monobasic amine salts of mixed mono- and di-acid phosphates and specialty amine salt of the diacid phosphate. The mono- and di-acid phosphate amines have the structural formula:

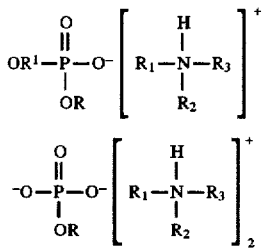

where

R and $R^1$ are the same or different and are $C_1$ to $C_{12}$ linear or branched chain alkyl $R_1$ and $R_2$ are H or $C_1$ to $C_{12}$ linear or branched chain alkyl $R_3$ is $C_4$ to $C_{12}$ linear or branched chain alkyl, or aryl-$R_4$ or $R_4$-aryl where R4 is H or $C_1$–$C_{12}$ alkyl, and aryl is $C_6$.

The preferred amine phosphates are those wherein R and $R^1$ are $C_1$–$C_6$ alkyl, and $R_1$ and $R_2$ are H or $C_1$–$C_4$, and $R_3$ is aryl-$R_4$ where $R_4$ is linear chain $C_4$–$C_{12}$ alkyl or $R_3$ is linear or branched chain $C_8$–$C_{12}$ alkyl.

The molar ratio of the mono- and diacid phosphate amine in the commercial amine phosphates of the present invention ranges from 1:3 to 3:1. Mixed mono-/di-acid phosphates and just diacid phosphate can be used, with the latter being the preferred.

The amine phosphates are used in an amount by weight in the range 50 to 300 ppm (based on base stock), preferably 75 to 250 ppm, most preferably 100 to 200 ppm amine phosphate.

Materials of this type are available commercially from a number of sources including R. T. Vanderbilt (Vanlube series) and Ciba Geigy.

The sulfur containing additives used in this invention include DMTD and the capped DMTD derivative (I) and the dimer (II) of the capped or uncapped DMTD (collectively referred to hereinafter and in the claims as DMTD), which are described by the structural formula:

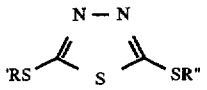

(I)

-continued

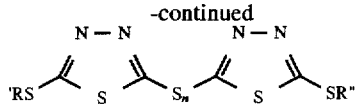

(II)

where R' and R" are same or different and are hydrogen, alkyl, hydroxyalkyl, cycloalkyl, alkyl-substituted cycloalkyl, aryl, alkylester, alkyl ether wherein R' and R" in total contain 30 carbons or less and n=1–2.

The DMTD is used in an amount by weight in the range 100 to 1000 ppm (based on polyol ester base stock), preferably 150 to 800 ppm, most preferably 250 to 500 ppm.

The amine phosphate(s) and the DMTD(s) are used in the weight ratio of 1:1 to 1:10, preferably 1:1.5 to 1:5, most preferably 1:2 to 1:3 amine phosphate(s):DMTD(s).

The synthetic oil based, preferably polyol ester-based high load-carrying oil may also contain one or more of the following classes of additives: antioxidants, antifoamants, antiwear agents, corrosion inhibitors, hydrolytic stabilizers, metal deactivator, detergents. Total amount of such other additives can be in the range 0.5 to 15 wt %, preferably 2 to 10 wt %, most preferably 3 to 8 wt %.

Antioxidants which can be used include aryl amines, e.g., phenyl-naphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an amount in the range 0.5 to 4 wt %, preferably 1 to 3 wt %.

Corrosion inhibitors include, but are not limited to, various triazols, e.g., tolyl triazol, 1,2,4-benzene triazol, 1,2,3-benzene triazol, carboxy benzotriazole, alkylated benzotriazol and organic diacids, e.g., sebacic acid.

The corrosion inhibitors can be used in an amount in the range 0.02 to 0.5 wt %, preferably 0.05% to 0.25 wt %.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pages 1–11, the disclosures of which are incorporated herein by reference.

The turbo oils of the present invention exhibit excellent load-carrying capacity as demonstrated by the severe FZG gear test, while meeting Si seal compatibility requirement set out by the United States Navy in MIL-L-23699 Specification. The polyol ester-based turbo oils to which have been added a synergistic mixture of the amine phosphate and the DMTD derivative produce a significant improvement in antiscuffing protection of heavily loaded gears over that of the same formulations without the amine phosphate and the DMTD derivative, and furthermore, attain the higher load capability than that achieved with one of these two additives used alone at a concentration greater than or comparable to that of the total S/P additive combination.

The present invention is further described by reference to the following non-limiting examples.

EXPERIMENTAL

In the following examples, a series of fully formulated aviation turbo oils were used to illustrate the performance benefits of using a mixture of the amine phosphate and DMTD derivative in the load-carrying and Si seal tests. A polyol ester base stock prepared by reacting technical pentaerythritol with a mixture $C_5$ to $C_{10}$ acids was employed along with a standard additive package containing from 1.7–2.5% by weight aryl amine antioxidants, 0.5–2% tri-aryl phosphates, and 0.1% benzo or alkyl-benzotriazole. To this was added various load-carrying additive package which consisted of the following:

1) Amine phosphate alone: Vanlube 692, a mixed mono-/di-acid phosphate amine, sold commercially by R. T. Vanderbilt 2) DMTD alone: DMTD per se, and two DMTD derivatives, one commercially available and the other experimental from Vanderbilt. 3) Combination (present invention): the combination of the two materials described in (1) and (2).

The load-carrying capacity of these oils was evaluated in the severe FZG gear test. The FZG gear test is an industry standard test to measure the ability of an oil to prevent scuffing of a set of moving gears as the load applied to the gears is increased. The "severe" FZG test mentioned here is distinguished from the FZG test standardized in DIN 51 354 for gear oils in that the test oil is heated to a higher temperature (140 versus 90° C.), and the maximum pitch line velocity of the gear is also higher (16.6 versus 8.3 m/s). The FZG performance is reported in terms of failure load stage (FLS), which is defined as a lowest load stage at which the sum of widths of all damaged areas exceeds one tooth width of the gear. Table 1 lists Hertz load and total work transmitted by the test gears at different load stages.

TABLE 1

| Load Stage | Hertz Load (N/mm$^2$) | Total Work (kWh) |
|---|---|---|
| 1 | 146 | 0.19 |
| 2 | 295 | 0.97 |
| 3 | 474 | 2.96 |
| 4 | 621 | 6.43 |
| 5 | 773 | 11.8 |
| 6 | 927 | 19.5 |
| 7 | 1080 | 29.9 |
| 8 | 1232 | 43.5 |
| 9 | 1386 | 60.8 |
| 10 | 1538 | 82.0 |

The Si seal [FED-STD-791; Method 3433] test used here to evaluate the turbo oils was run under the standard conditions as required by the Navy MIL-L-23699 specification.

The results from the severe FZG and Si seal tests are shown in Tables 2 and 3, respectively. The wt % concentrations (based on the polyol ester base stock) of the amine phosphate and DMTD derivative, either used alone or in combination, are also specified in the tables. Table 2 demonstrates that the combination of the amine phosphate and the DMTD derivative exhibits an excellent load-carrying capacity, which is better than that attributed to each additive used alone at a higher or comparable treat rate. The lower P-based additive concentration requirement to achieve the high load-carrying capacity allows the synergistic P/S load additive-containing formulation to meet the MIL-L-23699 Si seal specification whereas 0.1% VL 692-containing formulation fails the Si seal test (see Table 3).

TABLE 2

| Load Additives | Severe FZG FLS |
|---|---|
| None | 4 |
| 0.02 wt % Vanlube (VL) 692 | 5 |
| 0.03% VL 692 | 6 |
| 0.05 wt % DMTD | 7 |
| 0.10 wt % VL 871 (DMTD derivative) | 5 |
| 0.10 wt % OD 911 (DMTD derivative) | 8 |
| 0.10 wt % VL 692 | 7 or 8 |
| 0.03 wt % DMTD + 0.03% VL 692 | 9 |
| 0.05 wt % VL 871 + 0.02% VL 692 | 7 |
| 0.10 wt % OD911 + 0.02% VL 692 | 10 |

TABLE 3

Si Seal Compatibility

| Load Additives | Δ Swell | % Tensile Strength Loss |
|---|---|---|
| None | 13.1 | 10.3 |
| 0.1% VL 692 | 3.9 | 84.4 |
| 0.02% VL 692 | 7.8 | 28.7 |
| 0.05 VL 871 + 0.02% VL 692 | 9.5 | 29.4 |
| Spec | 5–25 | <30 |

What is claimed is:

1. A method for enhancing the load-carrying capacity of a turbo oil comprising a major amount of a base stock of a synthetic base oil selected from diesters and polyol ester base oil suitable for use as a turbo oil base stock by adding to said turbo oil base stock a minor amount of load carrying additive comprising a mixture of 2,5-dimercapto-1,3,4-thiadiazole (DMTD), its derivatives and mixtures thereof wherein the DMTD derivative is described by the formula

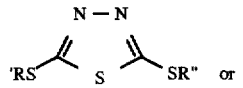

or

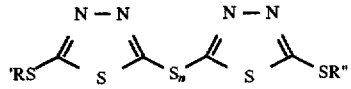

wherein R' and R" are the same or different and are hydrogen alkyl hydroxy alkyl, cycloalkyl alkyl-substituted cycloalkyl aryl alkylester, alkyl ether wherein R' and R" in total contain 30 carbons or less and n=1–2, and one or more amine phosphate(s) wherein the amine phosphate(s) is (are) monobasic hydrocarbyl amine salts of mixed mono- and di-acid phosphate(s), and wherein the DMTD, its derivative (s) and mixtures thereof is present in an amount by weight in the range of 100 to 1000 ppm and the amine phosphate(s) is present in an amount by weight in the range of 50 to 300 ppm, based on base stock.

2. The method of claim 1 wherein the base stock is a synthetic polyol ester.

3. The method of claim I wherein the DMTD derivative is DMTD described by the structural formula

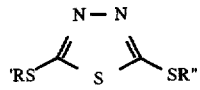

where R' and R" are same or different and are hydrogen, alkyl, hydroxyalkyl, cycloalkyl, alkyl-substituted cycloalkyl, aryl, alkylester, alkyl ether wherein R' and R" in total contain 30 carbons or less.

4. The method of claim 1 wherein the DMTD derivative is the dimer of the DMTD described by the formula

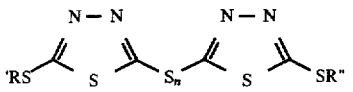

where R' and R" are same or different and are hydrogen, alkyl hydroxyalkyl cycloalkyl, alkyl-substituted cycloalkyl, aryl, alkylester, alkylether wherein R' and R" in total contain 30 carbons or less and n=1–2.

5. The method of claim 1 wherein the amine phosphate and the DMTD derivative are used in a weight ratio of 1:1 to 1:10.

6. The method of claim 1 wherein the amine phosphate is of the structural formula

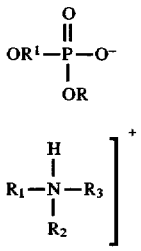

-continued

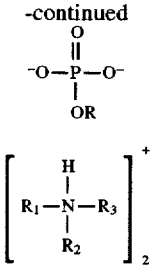

where

R and $R^1$ are the same or different and are $C_1$ to $C_{12}$ linear or branched chain alkyl;

$R_1$ and $R_2$ are H or $C_1$–$C_{12}$ linear or branched chain alkyl;

$R_3$ is $C_4$ to $C_{12}$ linear or branched chain alkyl or aryl -$R_4$ or $R_4$-aryl where $R_4$ is H or $C_1$–$C_{12}$ alkyl, and aryl is $C_6$.

7. The method of claim 6 wherein R and $R^1$ are $C_1$ to $C_6$ alkyl, and $R_1$ and $R_2$ are H or $C_1$–$C_4$, and $R_3$ is aryl-$R_4$ where $R_4$ is linear chain $C_4$–$C_{12}$ alkyl; or $R_3$ is linear or branched $C_8$–$C_{12}$ alkyl, and aryl is $C_6$.

8. The method of claim 6 wherein the amine phosphate and the DMTD, its derivative(s) or mixture thereof are used in a weight ratio of 1:1.5 to 1:5.

* * * * *